US007520581B2

(12) United States Patent
Iriguchi

(10) Patent No.: US 7,520,581 B2
(45) Date of Patent: Apr. 21, 2009

(54) INK DROPLET EJECTION DEVICE

(75) Inventor: Akira Iriguchi, Ichinomiya (JP)

(73) Assignee: Brother Kogyo Kabushiki, Nagoya-shi, Aichi-ken (JP)

( * ) Notice: Subject to any disclaimer, the term of this patent is extended or adjusted under 35 U.S.C. 154(b) by 491 days.

(21) Appl. No.: 11/358,076

(22) Filed: Feb. 22, 2006

(65) Prior Publication Data

US 2006/0187276 A1 Aug. 24, 2006

(30) Foreign Application Priority Data

Feb. 22, 2005 (JP) ..... 2005-045506

(51) Int. Cl.
*B41J 29/38* (2006.01)
*B41J 2/045* (2006.01)

(52) U.S. Cl. ..... 347/11; 347/68

(58) Field of Classification Search ..... 347/9, 347/11, 68, 70–72
See application file for complete search history.

(56) References Cited

U.S. PATENT DOCUMENTS 5,402,159 A 3/1995 Takahashi et al.
6,431,674 B2 * 8/2002 Suzuki et al. ..... 347/10
6,663,208 B2 12/2003 Suzuki et al.
6,840,595 B2 * 1/2005 Kusunoki ..... 347/10

FOREIGN PATENT DOCUMENTS

JP 4341853 11/1992
JP 952357 2/1997
JP 2002160362 6/2002

* cited by examiner

*Primary Examiner*—An H Do
(74) *Attorney, Agent, or Firm*—Baker Botts, LLP

(57) ABSTRACT

An ink droplet ejection device including: (a) actuators each operable to apply an ejection pressure to an ink stored in a corresponding pressure chamber, for causing an ink ejection through a corresponding nozzle, whereby an image formed as a result of the ink ejection is produced on a medium; and (b) a controller supplying a control signal to each actuator, and including (b-1) a portion operable to incorporate a composite-dot forming pulse train into the control signal, for causing successive ejection of a plurality of ink droplets that cooperate to form a composite dot of the image, and (c) a portion operable to incorporate a non-composite-dot forming pulse train into the control signal, for causing an ejection of a single ink droplet that forms a non-composite dot of the image. The composite-dot forming pulse train and non-composite-dot forming pulse train have respective waveforms configured such that an ejection velocity of the single ink droplet forming the non-composite dot is lower than an ejection velocity of said plurality of ink droplets cooperating to form the composite dot.

10 Claims, 9 Drawing Sheets

V1=9. 0m/s

V2=8. 0m/s

V3=7. 5m/s

FIG.9

| WAVEFORM | No. | PULSE WIDTH OR SEPARATION(μ sec) | | | EJECTION VELOCITY | EJECTION STABILITY | EJECTION AMOUNT |
|---|---|---|---|---|---|---|---|
| | | T1 | W1 | T2 | | | |
| SMALL-SIZED DOT | 1 | 3 | 2.6 | 1.8 | × | ○ | ○ |
| | 2 | 3 | 3 | 1.8 | × | ○ | ○ |
| | 3 | 3 | 3.4 | 1.8 | × | ○ | ○ |
| | 4 | 3 | 3.8 | 1.8 | × | ○ | ○ |
| | 5 | 3.4 | 2.6 | 1.8 | △ | ○ | ○ |
| | 6 | 3.4 | 3 | 1.8 | △ | ○ | ○ |
| | 7 | 3.4 | 3.4 | 1.8 | △ | ○ | ○ |
| | 8 | 3.4 | 3.8 | 1.8 | △ | ○ | ○ |
| | 9 | 3.8 | 2.6 | 1.8 | △ | ○ | ○ |
| | * 10 | 3.8 | 3 | 1.8 | ○ | ○ | ○ |
| | * 11 | 3.8 | 3.4 | 1.8 | ○ | ○ | ○ |
| | 12 | 3.8 | 3.8 | 1.8 | ○ | △ | △ |
| | * 13 | 4.2 | 2.6 | 1.8 | ○ | ○ | ○ |
| | * 14 | 4.2 | 3 | 1.8 | ○ | ○ | ○ |
| | 15 | 4.2 | 3.4 | 1.8 | ○ | △ | △ |
| | 16 | 4.2 | 3.8 | 1.8 | ○ | △ | △ |
| MEDIUM-SIZED DOT | 21 | 4 | 8.8 | 7.2 | ○ | △ | ○ |
| | 22 | 4 | 9.2 | 7.2 | ○ | △ | ○ |
| | 23 | 4 | 9.6 | 7.2 | ○ | △ | ○ |
| | 24 | 4 | 9.2 | 6.8 | ○ | × | ○ |
| | 25 | 4 | 9.2 | 7.6 | ○ | × | ○ |
| | 26 | 5 | 8.2 | 7.6 | △ | ○ | ○ |
| | 27 | 5 | 8.6 | 7.6 | △ | ○ | ○ |
| | 28 | 5 | 9 | 7.6 | △ | ○ | ○ |
| | 29 | 5 | 8.6 | 7.2 | △ | △ | ○ |
| | 30 | 5 | 8.6 | 8 | △ | △ | ○ |
| | * 31 | 6 | 7.6 | 7.2 | ○ | ○ | ○ |
| | * 32 | 6 | 8 | 7.2 | ○ | ○ | ○ |
| | * 33 | 6 | 8.4 | 7.2 | ○ | ○ | ○ |
| | 34 | 6 | 8 | 6.8 | ○ | △ | ○ |
| | 35 | 6 | 8 | 7.6 | ○ | △ | ○ |

INK DROPLET EJECTION DEVICE

This application is based on Japanese Patent Application No. 2005-045506 filed in Feb. 22, 2005, the content of which is incorporated hereinto by reference.

BACKGROUND OF THE INVENTION

1. Field of the Invention

The present invention relates to an ink droplet ejection device.

2. Discussion of Related Art

As an ink droplet ejection device, there is known a recording head that is to be incorporated in an inkjet printer. U.S. Pat. No. 6,663,208 (corresponding to JP-2002-160362A) discloses such a recording head including: (a) a cavity unit having (a-1) a plurality of nozzles located in its front portion, (a-2) a plurality of pressure chambers located in its rear portion and held in communication with the respective nozzles, and (a-3) a common ink chamber held in communication with the pressure chambers so as to distribute an ink supplied from an ink source, into the pressure chambers; and (b) a piezoelectric actuator unit fixedly disposed on the rear portion of the cavity unit. The piezoelectric actuator unit includes a plurality of deformable portions serving as actuators. Each of the deformable portions is arranged to be deformable with application of a drive pulse signal (voltage) thereto so as to change a volume of a corresponding one of the pressure chambers and apply an ejection pressure to an ink stored in the corresponding pressure chamber, so that the ink is ejected from the corresponding pressure chamber through one of the nozzles that is held in communication with the corresponding pressure chamber. The ejected ink takes a form of an ink droplet that is received in a recording medium, whereby an ink dot is formed on the recording medium. The recording head is arranged to be reciprocably movable in a main scanning direction (i.e., a width direction of the recording medium) that is perpendicular to a sub-scanning direction (i.e., a feeding direction of the recording medium).

It is common that an inkjet printer is arranged to form various kinds of dots having respective different sizes, so that a recorded area per dot is variable as needed. With combination of the various kinds of dots, an image with a desired gradation can be produced on a medium such as a paper sheet. The various kinds of dots can be categorized into a large-sized dot, a medium-sized dot and a small-sized dot, and also can be categorized into a composite dot that is formed by a plurality of ink droplets and a non-composite dot that is formed by a single ink droplet.

The present inventor conducted an experiment with respect to formations of a large-sized dot, a medium-sized dot and a small-sized dot. In the experiment, a large-sized-dot forming pulse train for forming the large-sized dot was configured such that two ink droplets were successively ejected and then united to each other before or after landing on the medium whereby the dot was formed by the united two ink droplets. A medium-sized-dot forming pulse train for forming the medium-sized dot was configured such that a single ink droplet was ejected whereby the dot was formed by the single ink droplet. A small-sized-dot forming pulse train for forming the small-sized dot was configured such that a single ink droplet was ejected whereby the dot was formed by the single ink droplet. The small-sized dot forming pulse train was different from the medium-sized-dot forming pulse train in that a drive pulse included therein had a pulse width deviated from a maximizing value that maximizes efficiency of the ink ejection, so that the ink droplet ejected by the small-sized dot forming pulse train had a volume smaller than the ink droplet ejected by the medium-sized-dot forming pulse train.

However, due to the above-described construction of the cavity unit in which the ink is distributed from the common chamber into the plurality of pressure chambers, when an ejection pressure is applied to at least one of the pressure chambers, the ejection pressure could be propagated to the other pressure chambers via the common chamber, thereby causing a so-called cross talk between the adjacent pressure chambers and inducing an ink ejection from the other pressure chambers.

The experiment conducted by the present inventor revealed that, when the small-sized or medium-sized dot and the large-sized dot were formed through nozzles adjacent to each other, the ejection velocity of the ink droplet for the small-sized or medium-sized dot was increased or reduced by influence of the cross talk. It was further confirmed that an extra ink in the form of extremely small or minute ink droplets was ejected in addition to the ink droplet forming the small-sized or medium-sized dot. The ejection of the minute ink droplets was caused easily when the ejection velocity of the ink droplet forming the small-sized or medium-sized dot was too large or too small. However, such minute ink droplets were not ejected through the nozzle assigned to successively eject two ink droplets forming the large-sized dot.

The minute ink droplets are not uniform in shape and size, and each of the minute ink droplets has a volume that is still smaller than a volume of each of so-called satellite ink droplets which are described in the above-identified U.S. Pat. No. 6,663,208. While the satellite ink droplets commonly land on the medium, the minute ink droplets are caused to float as ink mists without landing on the medium, due to their small volumes. The floating ink mists could stick inside an image forming apparatus incorporating therein a recording head, thereby causing a risk of malfunction in various operations performed by the image forming apparatus.

SUMMARY OF THE INVENTION

It is therefore an object of the invention to provide an ink droplet ejection device capable of preventing, upon formation of a non-composite dot such as small-sized or medium-sized dot, ejection of minute ink droplets forming problematic ink mists, where the non-composite dot is formed together with formation of a composite dot such as large-sized dot. The object may be achieved according to either one of first and second aspects of the invention that are described below.

The first aspect of the invention provides an ink droplet ejection device including: a plurality of nozzles; a plurality of pressure chambers held in communication with the respective nozzles; a common ink chamber held in communication with the pressure chambers so as to distribute an ink into the pressure chambers; a plurality of actuators each operable to apply an ejection pressure to the ink stored in a corresponding one of the pressure chambers, for causing an ink ejection from the corresponding one of the pressure chambers through one of the nozzles that is held in communication with the corresponding pressure chamber, whereby an image formed as a result of the ink ejection is produced on a medium; and a controller operable to supply a control signal to each of the plurality of actuators, and including (a) a composite-dot forming command portion operable to incorporate a composite-dot forming pulse train into the control signal supplied to each of the plurality of actuators, for causing the corresponding pressure chamber to successively eject a plurality of ink droplets that cooperate with each other to form a composite dot of the image, and (b) a non-composite-dot forming command portion operable to incorporate a non-composite-dot forming pulse train into the control signal, for causing the corresponding pressure chamber to eject a single ink droplet that forms a non-composite dot of the image. The composite-dot forming pulse train and the non-composite-dot forming pulse train have respective waveforms that are configured such that an ejection velocity of the single ink droplet forming the non-composite dot is lower than an ejection velocity of the plurality of ink droplets cooperating to form the composite dot.

In the ink droplet ejection device defined in the first aspect of the invention, the ejection velocity of the single ink droplet forming the non-composite dot (such as medium-sized or small-sized dot described below in the second aspect of the invention) is lower than the ejection velocity of the plurality of ink droplets forming the composite dot (such as large-sized dot described below in the second aspect of the invention). In the experiment conducted by the present inventor, it was confirmed that, if the ejection velocity of the single ink droplet forming the non-composite dot is as high as the ejection velocity of the plurality of ink droplets forming the composite dot, the ejection velocity of the single ink droplet is further increased by influence of the cross talk, and the excessively increased ejection velocity causes ejection of an extra ink in the form of minute ink droplets forming problematic ink mists. Therefore, the arrangement in which the ejection velocity of the single ink droplet forming the non-composite dot is set to be lower than the ejection velocity of the plurality of ink droplets forming the composite dot is effective to restrain the ejection velocity of the single ink droplet from being excessively increased, even in presence of influence of the cross talk. Consequently, it is possible to prevent the ejection of the minute ink droplets and avoid contamination arising from formation of the ink mists.

According to the second aspect of the invention, in the ink droplet ejection device in the first aspect of the invention, the composite-dot forming command portion of the controller includes a large-sized dot forming command portion operable to incorporate a large-sized-dot forming pulse train into the control signal, for causing formation of a large-sized dot as the composite dot by the plurality of ejected ink droplets. The non-composite-dot forming command portion of the controller includes (b-1) a medium-sized-dot forming command portion operable to incorporate a medium-sized-dot forming pulse train into the control signal, for causing formation of a medium-sized dot as the non-composite dot by the ejected single ink droplet, and (b-2) a small-sized-dot forming command portion operable to incorporate a small-sized-dot forming pulse train into the control signal, for causing formation of a small-sized dot as the non-composite dot by the ejected single ink droplet. The large-sized-dot forming pulse train, medium-sized-dot forming pulse train and small-sized-dot forming pulse train have respective waveforms that are configured, such that an ejection velocity of the ejected single ink droplet forming the medium-sized dot is lower than an ejection velocity of the plurality of ejected ink droplets forming the large-sized dot, and is higher than an ejection velocity of the ejected single ink droplet forming the small-sized dot.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIG. 9 is a table showing a result in an experiment conducted with various combinations of pulse width values in each of the pulse trains for forming the medium-sized and small-sized dots.

DETAILED DESCRIPTION OF THE PREFERRED EMBODIMENT

Figure 1:
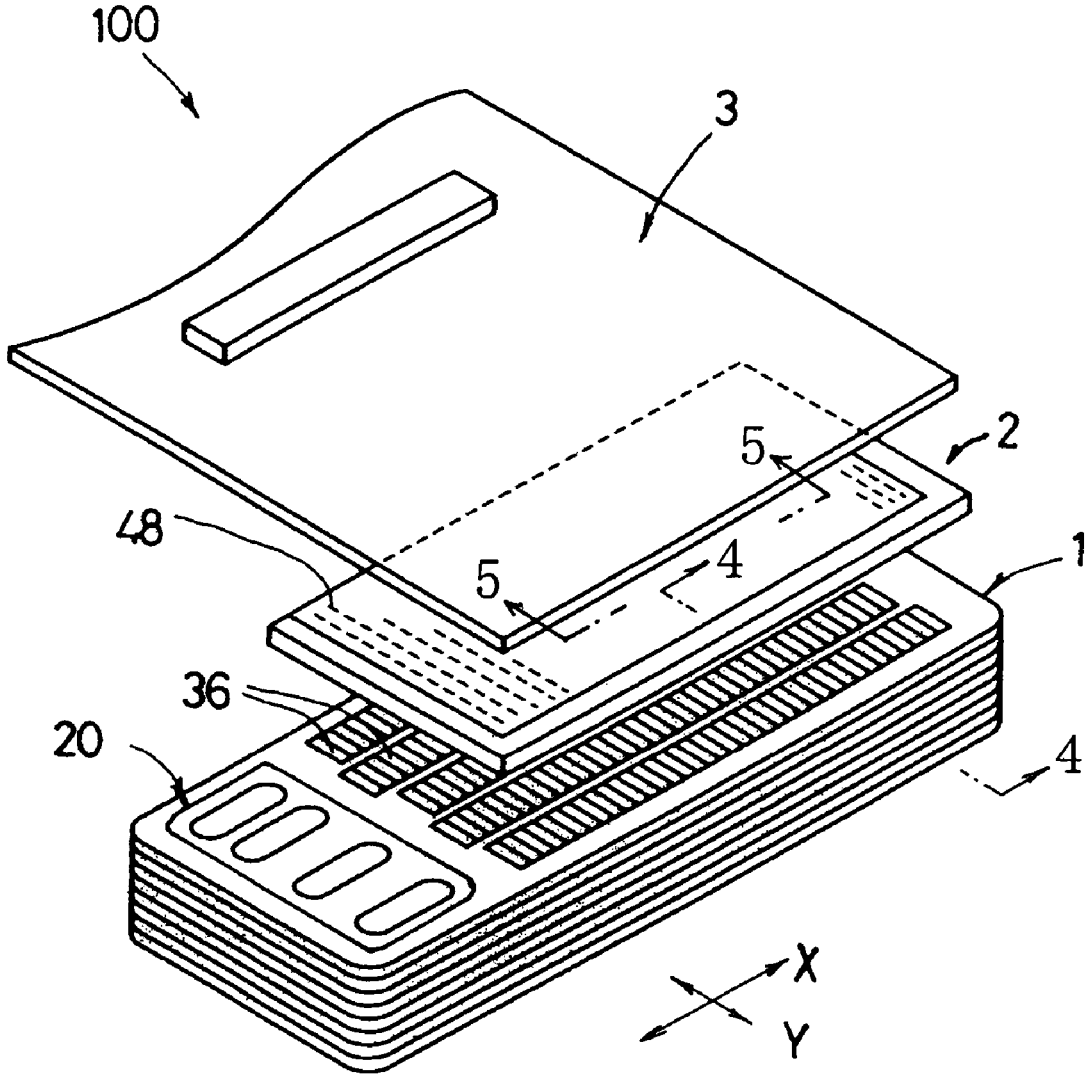
FIG. 1 is a perspective and exploded view showing an inkjet head constructed according to an embodiment of the invention.

The present invention is applicable to an ink droplet ejection device such as a recording head (hereinafter referred to as "inkjet head") 100, as shown in FIG. 1, which is constructed according to the invention. This inkjet head 100 is to be mounted on a carriage (not shown) of an inkjet printer, which is arranged to be reciprocably movable in a main scanning direction that is perpendicular to a sub-scanning direction in which a recording medium is to be fed. The inkjet printer is equipped with ink cartages (not shown) that are removably mounted on the carriage or disposed on a stationary portion of the printer, such that each of inks of four colors (e.g., black, cyan, yellow and magenta) stored in the respective ink cartridges can be supplied directly or through supplying pipes to the inkjet head 100. It is noted that, in the following description, the main scanning direction is referred also to as "second direction" or "X direction" while the sub-scanning direction is referred also to as "first direction" or "Y direction".

As shown in FIG. 1, the inkjet head 100 includes a cavity unit 1 provided by a plurality of metal plates, and a plate-shaped piezoelectric actuator unit 2 fixedly superposed on the cavity unit 1. A flexible flat cable 3 for connection with an external device is superposed on and bonded to an upper surface of the piezoelectric actuator unit 2 (see FIG. 4). The cavity unit 1 has a lower surface (front surface) in which a multiplicity of nozzles 4 are open, so that an ink droplet is downwardly ejected through the nozzles 4.

Figure 2:
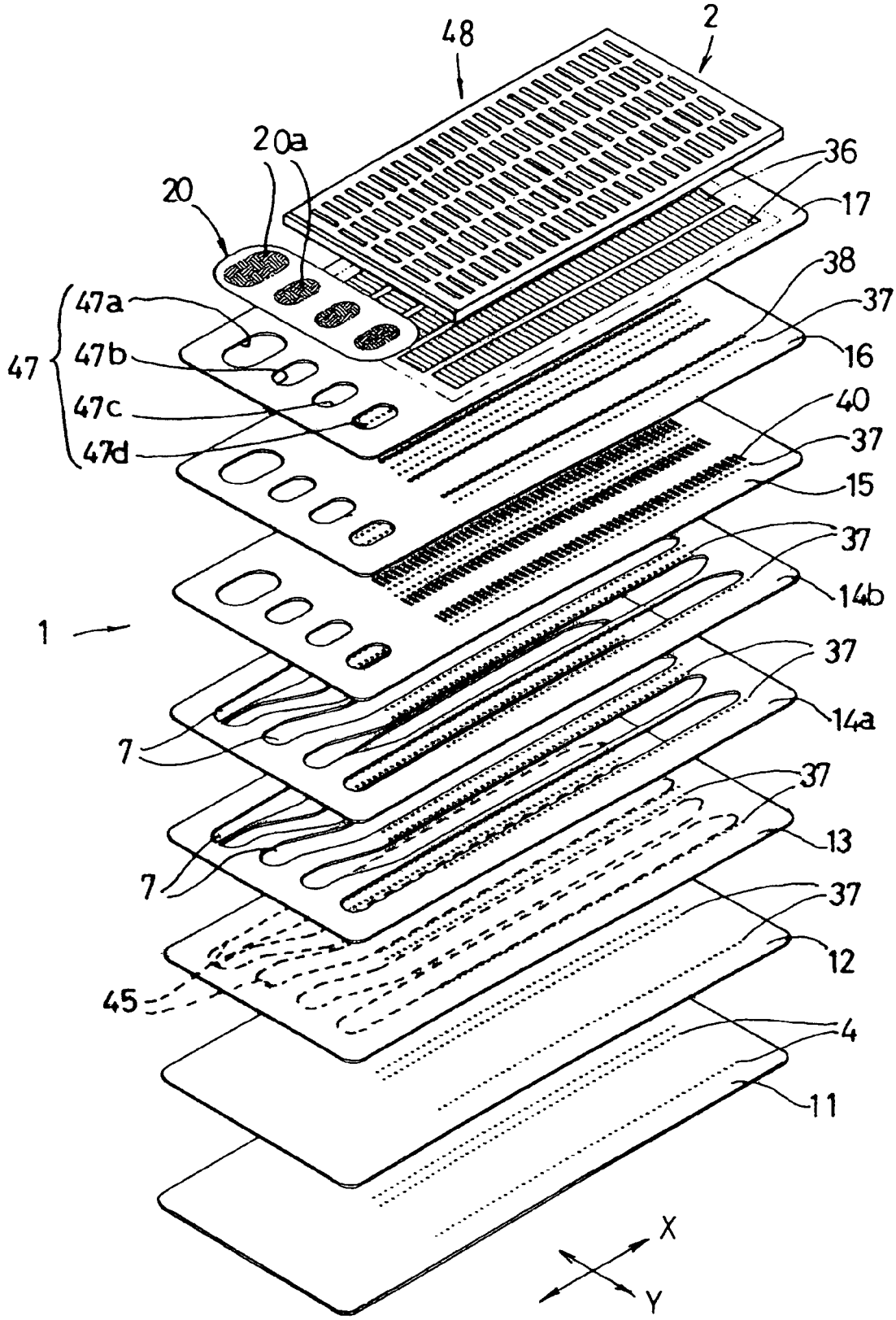
FIG. 2 is a perspective and exploded view showing a cavity unit and an actuator unit of the inkjet head of FIG. 1.

As shown in FIG. 2, the cavity unit 1 is a laminar structure consisting of a total of eight thin plates superposed on each other in a vertical direction of the inkjet head 100 and bonded together by an adhesive. The eight thin plates consist of a nozzle plate 11, a spacer plate 12, a damper plate 13, two manifold plates 14X, 14Y, a supply plate 15, a base plate 16 and a cavity plate 17.

In the present embodiment, each of the plates 11-17 has a thickness of about 50-150 μm. The nozzle plate (lowermost plate) 11 is formed of a synthetic resin such as polyamide, while each of the other plates 12-17 is formed of a steel alloy containing 42% of nickel. Each of the nozzles 4, formed through the nozzle plate 11, has an extremely small diameter (about 25 μm in this embodiment). The nozzles 4 are arranged at a predetermined small pitch in five parallel rows extending in the X direction (i.e., in a longitudinal direction of the nozzle plate 11).

Figure 3:
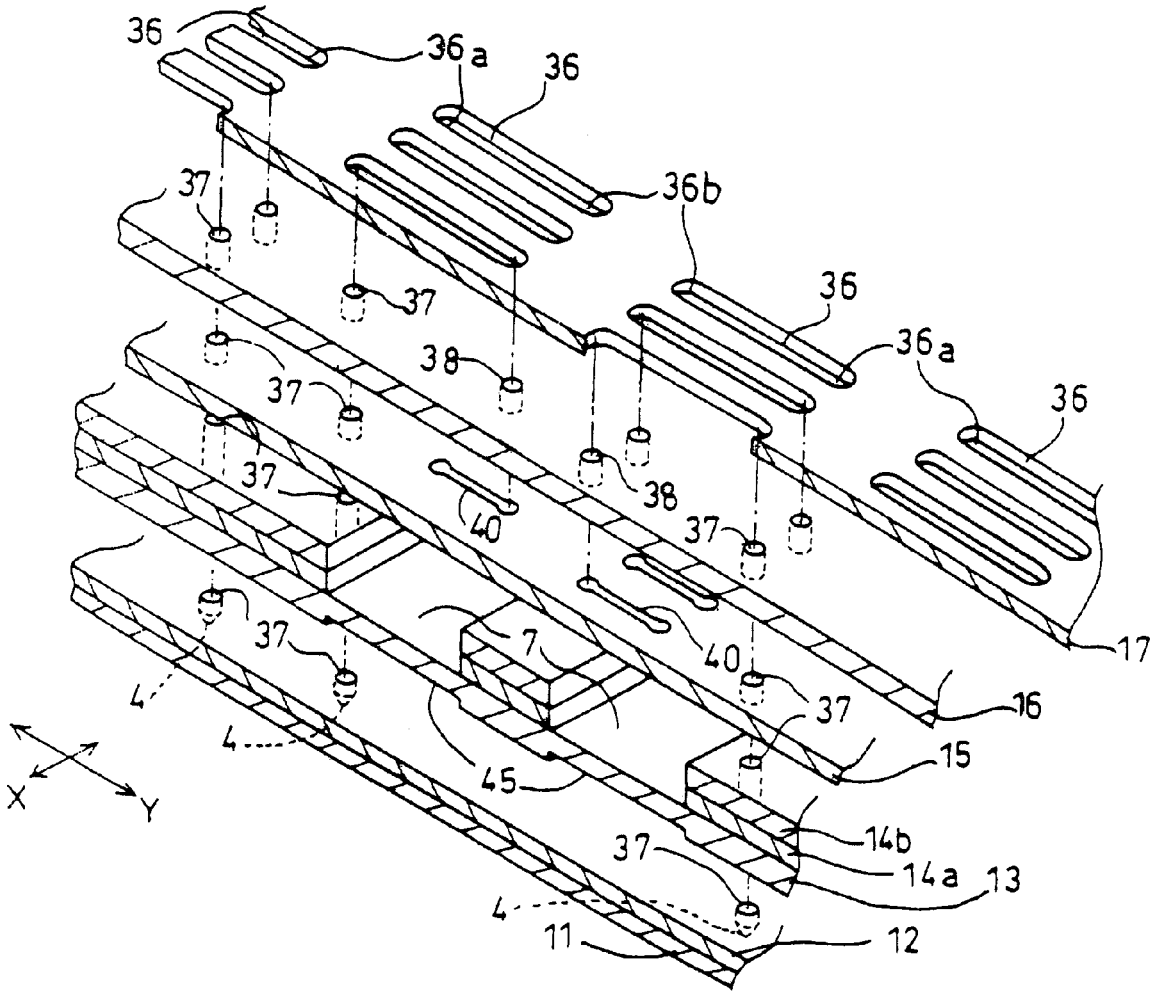
FIG. 3 is a perspective and exploded view in enlargement showing a part of the cavity unit of FIG. 2.

In the cavity plate (uppermost plates) 17, a multiplicity of pressure chambers 36 are formed to be arranged in five parallel rows extending in the above-described X direction, as shown in FIG. 3. In the present embodiment, each of the pressure chambers 36 is elongated in the Y direction (i.e., in a width direction of the cavity plate 17). Each elongated pressure chamber 36 is held in communication at its longitudinal end portion 36*a* with the corresponding nozzle 4, and is held in communication at another longitudinal end portion 36*b* with a common chamber (manifold chamber) 7.

The pressure chambers 36 are held in communication at the respective longitudinal end portions 36*a* with the respective nozzles 4 via respective ink delivery passage in the form of communication holes 37 which have an extremely small diameter and which are formed through the base plate 16, supply plate 15, two manifold plates 14*a*, 14*b*, damper plate 13 and spacer plate 12.

The base plate 16, which is held in contact with a lower surface of the cavity plate 17, has through-holes 38 formed therethrough and connected to the longitudinal end portions 36*b* of the respective pressure chambers 36.

The supply plate 15, which is held in contact with a lower surface of the base plate 16, defines horizontally extending connection passages 40 through which the ink is supplied from the common chamber 7 to the respective pressure chambers 36. Each of the connection passages 40 has an inlet portion through which the ink flows from the common chamber 7, and an outlet portion which opens in the corresponding through-hole 38 connected to the corresponding pressure chamber 36. Each connection passage 40 has a flow restrictor portion which is located between the inlet and outlet portions, and a cross sectional area which is made relatively small in the flow restrictor portion for applying a resistance to flow of the ink.

The two manifold plates 14*a*, 14*b* cooperate to partially define five common chambers 7 which are formed through the entire thickness of each of the two manifold plates 14*a*, 14*b*. The five common chambers 7 are elongated in the above-described X direction, so as to extend along the respective rows of the nozzles 4 which also extend in the X direction. The five common chambers 7 are defined by the two manifold plates 14*a*, 14*b* superposed on each other, the supply plate 15 superposed on an upper surface of the manifold plate 14*b*, and the damper plate 13 underlying a lower surface of the manifold plate 14*a*. Each common chamber 7 is elongated in a direction substantially parallel with the rows of the pressure chambers 36 (the rows of the nozzles 4), and has a portion which overlaps the pressure chambers 36 arranged in a corresponding one of the rows, as seen in the plan view, i.e., as viewed in the vertical direction in which the eight thin plates 11-17 are superposed on each other.

Figure 4:
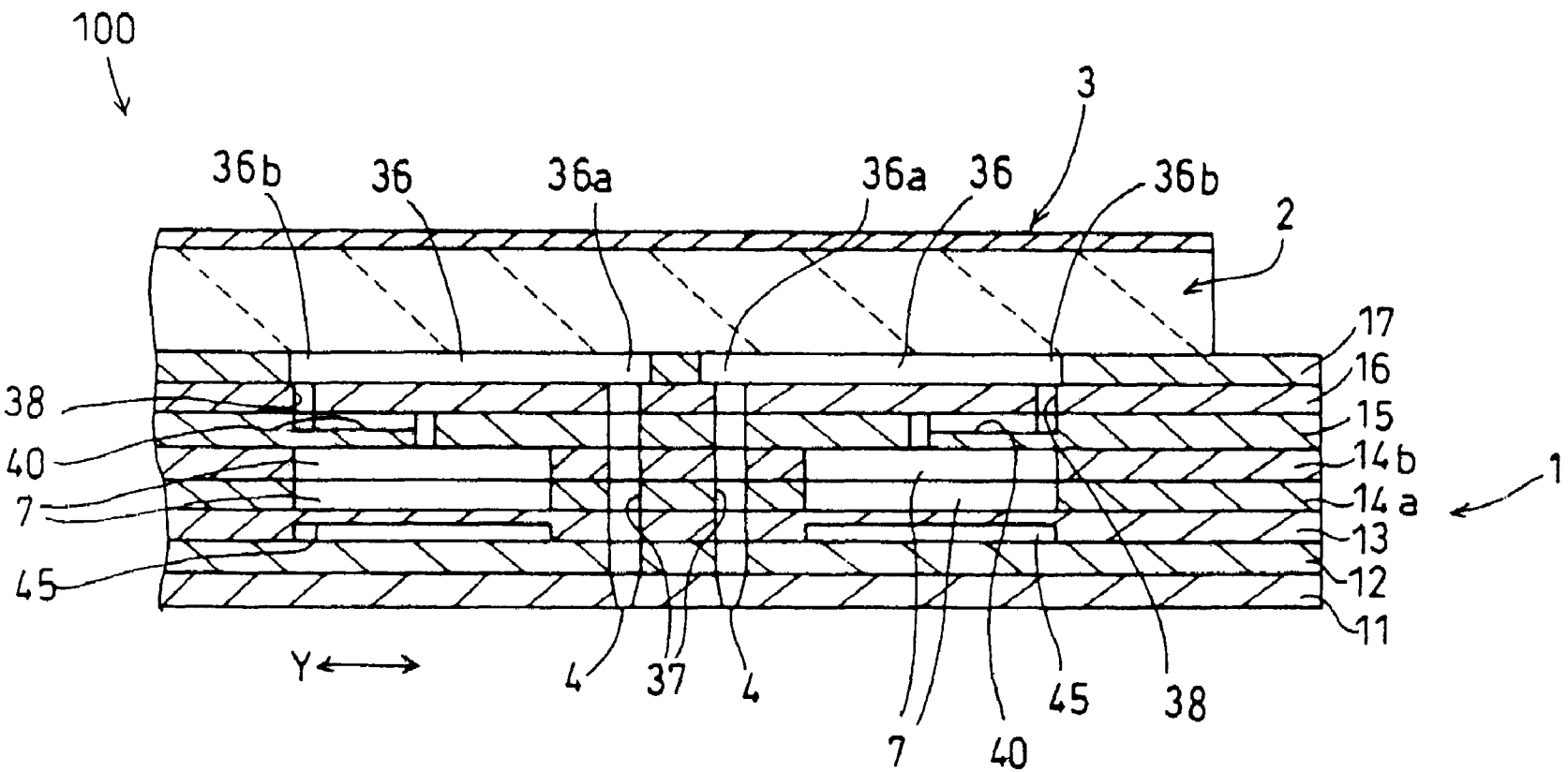
FIG. 4 is a cross sectional view taken along line 4-4 of FIG. 1.

The damper plate 13, which is held in contact with a lower surface of the manifold plate 14*a*, has five damper chambers 45 which are provided by recesses formed on a lower surface of the damper plate 13, such that the damper chambers 45 are isolated from the common chambers 7, as shown in FIGS. 3 and 4. Each damper chamber 45 is positioned and configured to overlap with the corresponding common chamber 7, as seen in the plan view. Since the damper plate 13 is provided by a metallic material that is suitably deformable in an elastic manner, its thin-walled ceiling portion defining an upper end of each damper chamber 45 is freely oscillable either upward or downward, namely, either toward the common chamber 7 or toward the damper chamber 45. Therefore, even if a pressure fluctuation generated in one of the pressure chambers 36 upon an ink ejection from the one of the pressure chambers 36 is propagated to the corresponding common chamber 7, the propagated pressure fluctuation can be absorbed or damped by oscillation of the elastically deformed ceiling portion. Thus, the damper plate 13 having the elastically deformable ceiling portion provides a damping effect preventing propagation of the pressure fluctuation from the one of the pressure chambers 36 to the other pressure chambers 36, namely, preventing a cross talk between the adjacent pressure chambers 36.

Each of the supply plate 15, base plate 16 and cavity plate 17 has four through-holes located in one of its longitudinal end portions, such that the four through-holes of each of the plates 15-17 are aligned with those of the other of the plates 15-17 in the vertical direction. Thus, the plates 15-17 cooperate to define four ink inlets 47 each of which is held in communication with one of opposite end portions of a corresponding one of the common chambers 7. In the following description, a leftmost one, a second leftmost one, a second rightmost one and a rightmost one of the four ink inlets 47 (as seen in FIG. 2) will be referred to as the ink inlets 47*a*, 47*b*, 47*c* and 47*d*, respectively.

The ink is supplied to the common chambers 7 through the respective ink inlets 47, and is then distributed into the pressure chambers 36 via the connection passages 40 of the supply plate 15 and the through-holes 38 of the base plate 16 (see FIG. 3). The ink stored in each of the pressure chambers 36 is caused by activation of a corresponding one of actuators of the actuator unit 2, to be delivered to the corresponding nozzles 4 via the corresponding through-hole 37. With application of an ejection pressure to the ink stored in the pressure chamber 36, a pressure wave is generated in the pressure chamber 35 and is transmitted via the corresponding through-hole 37 to the corresponding nozzle 4, whereby the ink delivered to the nozzle 4 is ejected toward the recording medium.

In the present embodiment, in which the number of the ink inlets 47 is four while the number of the common chambers 7 is five (see FIG. 2), the ink inlet 47*a* assigned to the black ink (BK) is held in communication with two of the five common chambers 7 (which are the leftmost two of the five common chambers 7 as seen in FIG. 2), rather than with only one of the five common chambers 7. This arrangement is based on a fact that the black ink (BK) tends to be consumed more than the other color inks. Each of the other ink inlets 47*b*, 47*c*, 47*d* respectively assigned to the cyan ink (C), yellow ink (Y) and magenta ink (M) is held in communication with a corresponding one of the common chambers 7. A cover plate 20 is bonded to a portion of the upper surface of the cavity plate 17 in which the ink inlets 47*a*, 47*b*, 47*a*, 47*d* open, such that filter portions 20*a* of the cover plate 20 are opposed to the respective openings of the ink inlets 47*a*, 47*b*, 47*c*, 47*d* (see FIGS. 1 and 2).

Figure 5:
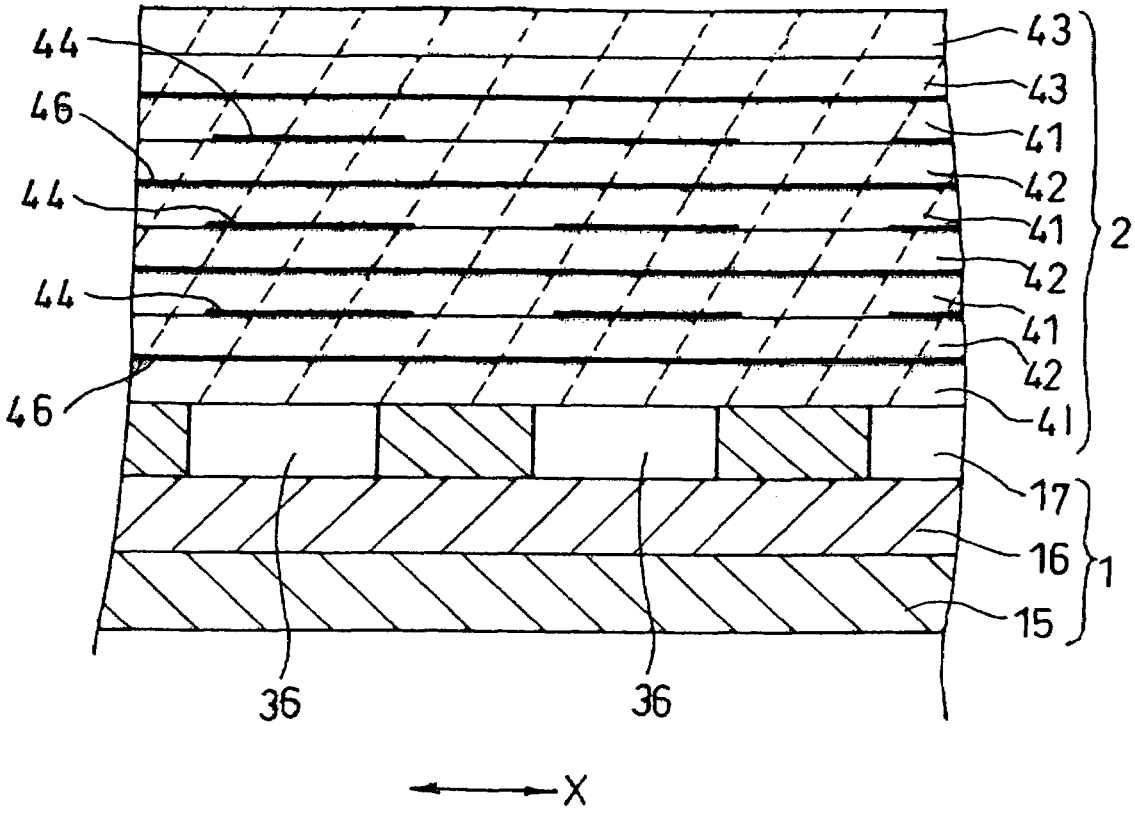
FIG. 5 is a cross sectional view taken along line 5-5 of FIG. 1.

On the other hand, as shown in FIG. 5, the piezoelectric actuator unit 2 is a laminar structure consisting of a plurality of piezoelectric sheets 41-43 (each having a thickness of about 30 μm) superposed on each other, like an actuator unit disclosed in U.S. Pat. No. 5,402,159 (corresponding to JP-H04-341853A). On an upper surface (i.e., surface having a relatively large width) of each of even-numbered ones 42 of the piezoelectric sheets (as counted from the lowermost piezoelectric sheet), there are formed individual electrodes 44 in the form of elongated strips which are aligned with the respective pressure chambers 36 of the cavity unit 1 and which are arranged in five rows parallel to the longitudinal direction of the piezoelectric sheet 42, i.e., the X-axis direction. On an upper surface of each of odd-numbered ones 41 of the piezoelectric sheets (as counted from the lowermost one), there is formed a common electrode 46 which is common to the plurality of pressure chambers 36. On an upper surface of the top sheet, there are formed surface electrodes 48 (see FIG. 1), some of which are electrically connected to the individual electrodes 44, and the other of which are electrically connected to the common electrodes 46.

In the piezoelectric actuator unit 2 constructed as described above, each of piezoelectric sheets has the same number of active portions as that of the pressure chambers 36. Each of the active portions is polarized upon application of a high voltage between the corresponding individual electrode 44 and the common electrode 46, in a known manner. The actuator unit 2 includes a plurality of actuators which are aligned with the respective pressure chambers 36. Each of the plurality of actuators of the actuator unit 2 is provided by corresponding ones of the active portions that are all aligned with the each actuator.

The lower surface of the plate-like piezoelectric actuator unit 2 (i.e., the surface opposed to the pressure chambers 36) is entirely covered by an adhesive sheet (not shown) formed of an ink impermeable synthetic resin, and the piezoelectric actuator unit 2 is then bonded at the adhesive sheet to the upper surface of the cavity unit 1 such that the individual electrodes 44 are aligned with the respective pressure chambers 36 formed in the cavity unit 1. Further, the flexible flat cable 3 is pressed onto the upper surface of the piezoelectric actuator unit 2, such that electrically conductive wires (not shown) of the flat cable 3 are electrically connected to the surface electrodes 48.

Figure 6:
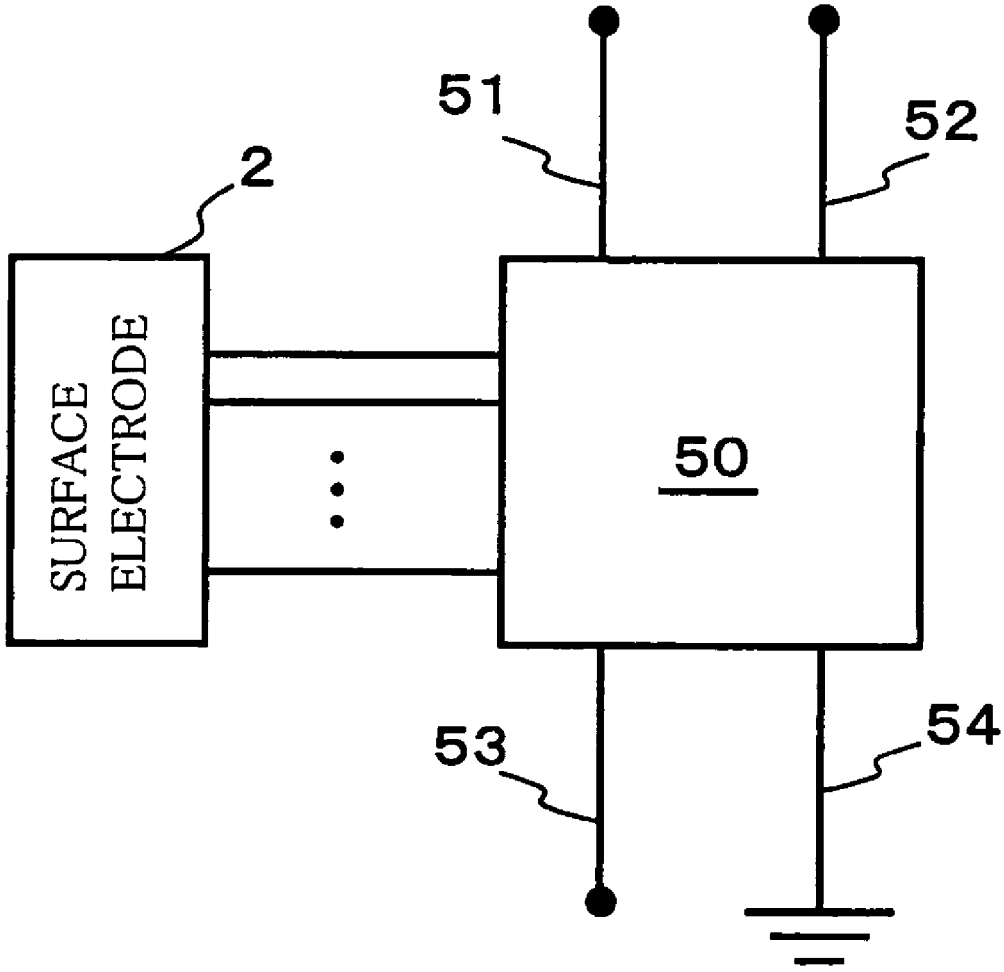
FIG. 6 is a block diagram of a controller.

There will be next described a construction of a controller that is operable to supply a control signal to each of the actuators of the actuator unit 2, with reference to FIG. 6. In the present embodiment, the controller takes the form of a LSI chip 50 that is disposed on the flexible flat cable 3. The LSI chip 50 is electrically connected to the individual and common electrodes 44, 46 via the surface electrodes 48. To the LSI chip 50, there are connected a clock line 51, a data line 52, a voltage line 53 and an earth line 54. The LSI chip 50 is operable to determine, based on clock pulses supplied from the clock line 51 and data supplied from the data line 52, which one or ones of the pressure chambers 36 should be selected as active pressure chamber or chambers from which the ink droplet is to be ejected. The LSI chip 50 controls the actuators corresponding to the selected pressure chambers 36 and also those corresponding to non-selected pressure chambers 36, by controlling a drive voltage that is to be applied to each of the individual electrodes 44. That is, the LSI chip 50 selectively applies the drive voltage (supplied from the voltage line 53) to the individual electrode 44 of each actuator of the actuator unit 2, and connects the individual electrode 44 of each actuator to the earth line 54, depending upon necessity of ejection of the ink droplet from the corresponding pressure chamber 36.

With application of a drive pulse by the controller to the individual electrode 44 of the actuator corresponding to the selected pressure chamber 36, the actuator is deformed or displaced whereby the ejection pressure is applied to the ink stored in the selected pressure chamber 36. The ink droplet is ejected from the nozzle 4, owing to a forward component of the pressure wave propagated from the pressure chamber 36 to the nozzle 4.

The inkjet printer (image forming apparatus) incorporating therein the inkjet head 100 constructed as described above is capable of forming various kinds of dots having respective different sizes, for producing an graded image in which a recorded area per dot is not constant.

Figure 7A:
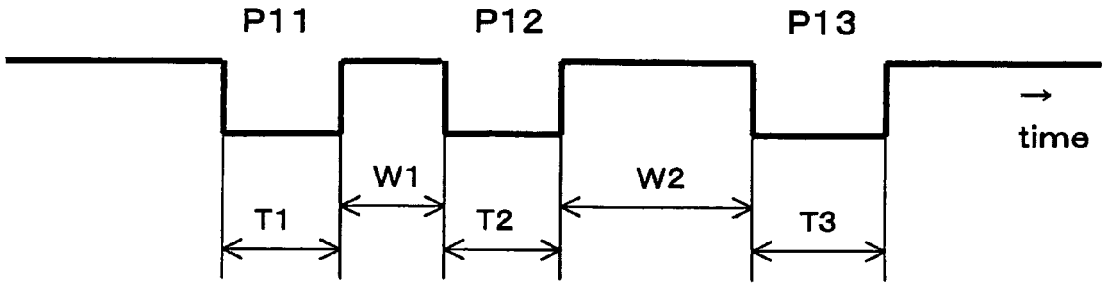
FIG. 7A is a view showing a waveform of a pulse train for forming a large-sized dot.
Figure 7B:
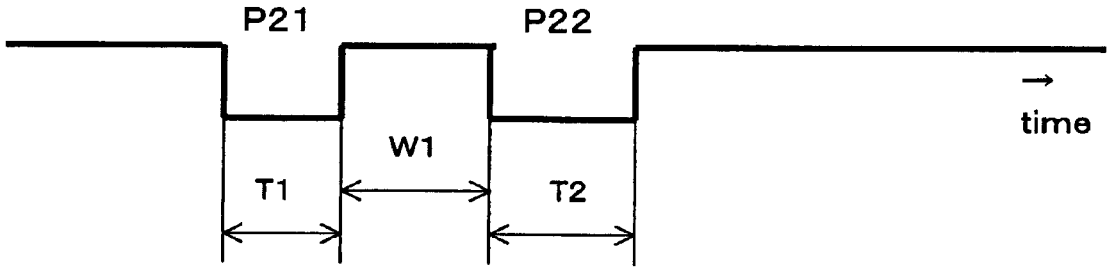
FIG. 7B is a view showing a waveform of a pulse train for forming a medium-sized dot.
Figure 7C:
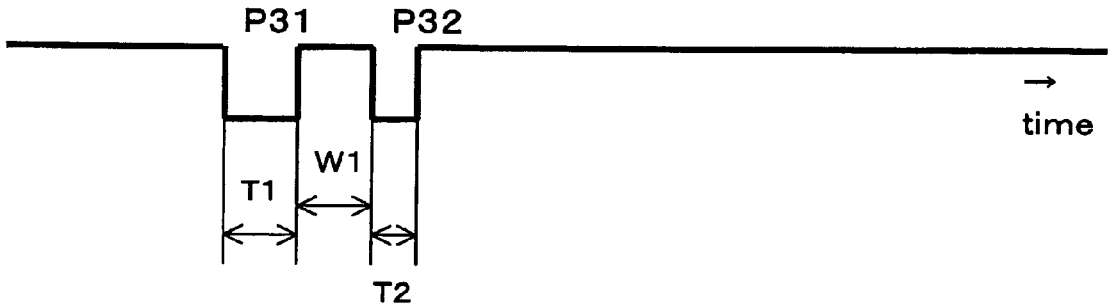
FIG. 7C is a view showing a waveform of a pulse train for forming a small-sized dot.

In the present embodiment, the controller includes (i) a large-sized dot forming command portion as a composite-dot forming command portion operable to incorporate a large-sized-dot forming pulse train into the control signal (supplied to each actuator), for causing formation of a large-sized dot by the plurality of ejected ink droplets, (ii) a medium-sized dot forming command portion as a non-composite-dot forming command portion operable to incorporate a medium-sized-dot forming pulse train into the control signal, for causing formation of a medium-sized dot by the ejected single ink droplet, and (iii) a small-sized dot forming command portion as another non-composite-dot forming command portion operable to incorporate a small-sized-dot forming pulse train into the control signal, for causing formation of a small-sized dot by the ejected single ink droplet. The large-sized dot is a composite dot formed of a plurality of ink droplets having a total volume of 10-40 pl (preferably 16 pl), the medium-sized dot is a non-composite dot formed of a single ink droplet having a volume of 3-10 pl (preferably 8 pl), and the small-sized dot is a non-composite dot formed of a single ink droplet having a volume of 1-5 pl (preferably 3 pl). The large-sized-dot forming pulse train includes three drive pulses P11, P12, P13, as shown in FIG. 7A. The medium-sized-dot forming pulse train includes two drive pulses P21, P22, as shown in FIG. 7B. The small-sized-dot forming pulse train includes two drive pulses P31, P32, as shown in FIG. 7C. Each of the large-sized, medium-sized and small-sized dots is formed by incorporating a corresponding one of the large-sized-dot, medium-sized-dot and small-sized-dot forming pulse trains, in the control signal supplied from the controller to each of the actuators. Each of the large-sized-dot, medium-sized-dot and small-sized-dot forming pulse trains has a waveform consisting of a plurality of first voltage-level regions and a plurality of second voltage-level regions that are alternately arranged. A voltage of the control signal is held in a first level in each of the first voltage-level regions, which causes each actuator to reduce the volume of the corresponding pressure chamber 36. The voltage of the control signal is held in a second level in each of the second voltage-level regions, which causes each actuator to increase the volume of the corresponding pressure chamber 36. Each of the drive pulses is provided by a corresponding one of the second voltage-level region.

In the present embodiment, the voltage of the control signal supplied to the individual electrode 44 of each actuator is held in a predetermined level as the above-described first level, until the corresponding pressure chamber 36 is selected as an active pressure chamber from which an ink ejection is to be caused. The voltage of the control signal is reduced to a ground level (e.g. substantially 0 V) as the above-described second level, when the corresponding pressure chamber 36 is selected as the active pressure chamber. That is, during absence of any command requesting the ink ejection, the predetermined level of the voltage is applied between each of all the individual electrodes 44 and the corresponding common electrode 46, so that the volume of each of all the pressure chambers 36 is held in its reduced state as a result of elongation of each of all the actuators. In response to a command requesting the ink ejection from one of the pressure chambers 36 as the selected pressure chamber, the application of the predetermined level of voltage to the individual electrodes 44 of the actuator corresponding to the selected pressure chamber 36 is suspended, whereby the volume of the selected pressure chamber 36 is placed in its increased state as a result of restoration of the corresponding actuator to its original shape, namely, as a result of contraction of the corresponding actuator. The increase in the volume of the selected pressure chamber 36 causes the ink stored in the selected pressure chamber 36 to be negatively pressurized, whereby a negative pressure wave is generated. Then, the predetermined level of the voltage is applied to the individual electrodes 44 of the corresponding actuator at a point of time at which the pressure of the ink in the selected pressure chamber 36 is inverted from its negative state to positive state. In this instance, the inverted pressure and the pressure caused by the elongation of the corresponding actuator are superimposed on each other, thereby causing the ink ejection from the selected pressure chamber 36 through the nozzle 11 that is held in communication with the selected pressure chamber 36.

A length of time required for transition of the pressure of the ink from negative peak to positive peak is dependent on an one-way propagation time, i.e., a length of time required for a pressure wave to be propagated in an ink channel from the common chamber 7 to the nozzle 4 via the pressure chamber 36. This one-way propagation time is dependent not only on a natural frequency of the ink and a length of the ink channel but also on a resistance acting against the ink flow and a rigidity of the plates defining the ink channel.

Figure 8:
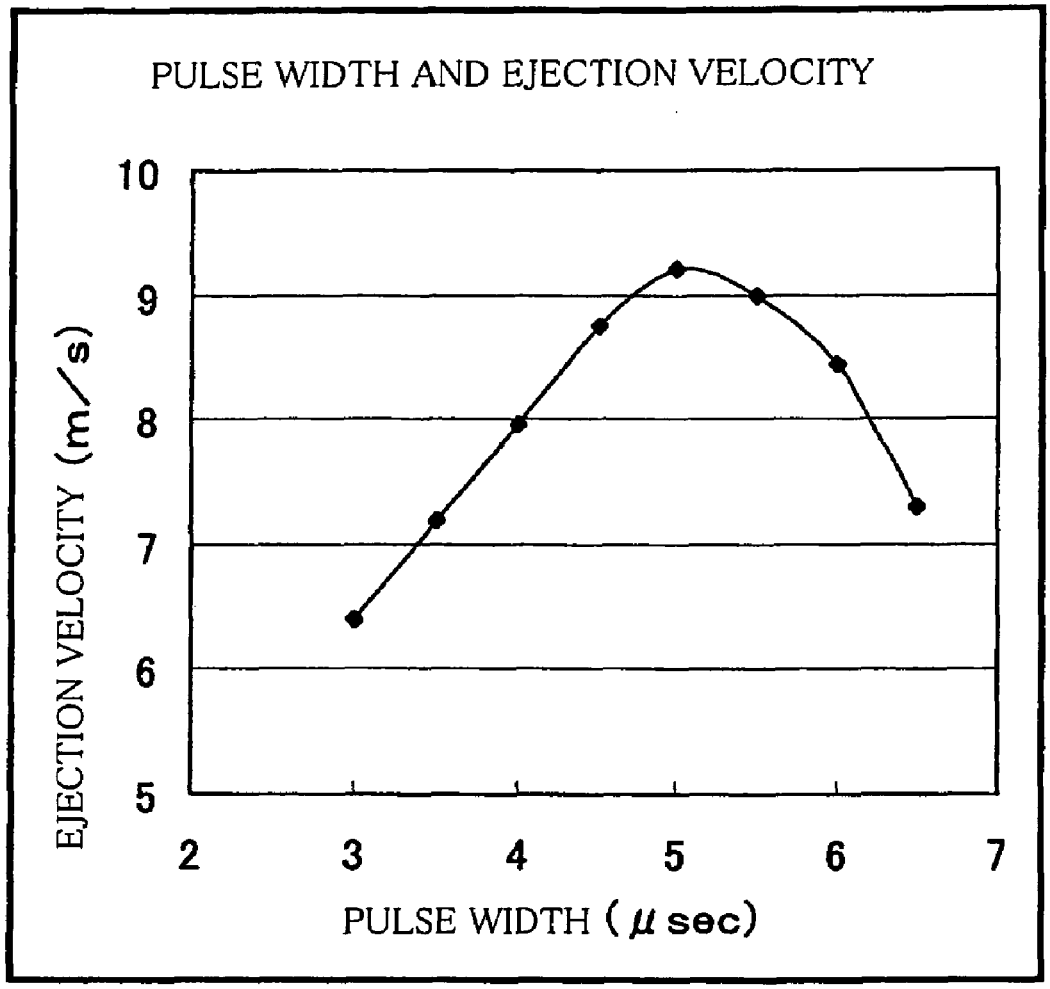
FIG. 8 is graph showing a relationship between a pulse width of a drive pulse and a velocity of ink droplet ejected by the drive pulse.

That is, where a pulse width of the drive pulse is adjusted to correspond to the above-described one-way propagation time, the pressures are superimposed most effectively, maximizing an ejection velocity and a volume of each ink droplet to be ejected. FIG. 8 is a graph showing a relationship between the pulse width and the ejection characteristic, wherein "T0" denotes a value (hereinafter referred to as "maximizing value") of the pulse width corresponds to the one-way propagation time. As is apparent from an upward convex curved line representative of the relationship, the ejection velocity and the volume of the ink droplet are maximized at the maximizing value T0 and are reduced as the pulse width is deviated from the maximizing value T0 in either of the opposite senses. It is noted that the term "pulse width" used in the present specification is interpreted to mean a leading edge (i.e., a transition from the first voltage-level region to the second voltage-level region) and a trailing edge (i.e., a transition from the second voltage-level region to the first voltage-level region) of the drive pulse. It is further noted that the term "maximizing value" may be referred also to as "peak-value establishing value" that causes the ejection velocity and the volume of each ejected ink droplet to be peaked.

The drive pulses P13, P22, each of which is a final one of the drive pulses of a corresponding one of the large-sized-dot forming pulse train and medium-sized-dot forming pulse train, serves as a canceling signal for canceling a residual pressure wave remaining in the ink (see FIGS. 7A and 7B). The canceling signal is arranged such that the applied voltage is placed from its first level to second level for increasing the volume of the pressure chamber when the pressure of the ink in the pressure chamber is in its positive state and is then placed from its second level to first level for reducing the volume of the pressure chamber when the pressure of the ink in the pressure chamber is in its negative state. Alternatively, the canceling signal is arranged such that the applied voltage is placed from its second level to first level for reducing the volume of the pressure chamber when the pressure of the ink is in its negative state and is then placed from its first level to second level for increasing the volume of the pressure chamber when the pressure of the ink in the pressure chamber is in its positive state.

In the small-sized-dot forming pulse train, an ink droplet is caused to be ejected by the drive pulse P31 as a first drive pulse, and a part of the ink droplet is inhibited by the drive pulse P32 as a second drive pulse from being ejected. The drive pulse P32 is arranged such that the applied voltage is placed from its first level to second level for increasing the volume of the pressure chamber at point of time at which the ink droplet (caused to be ejected by the drive pulse P31) still sticks to the nozzle. Thus, by the drive pulse P32, the ink droplet is partially pulled back, so that a volume of the ejected ink droplet is reduced. Further, the drive pulse P32 serves to cancel a residual pressure wave generated by the preceding drive pulse P31, since the drive pulse P32 is arranged to increase the volume of the pressure chamber when the pressure of the ink in the pressure chamber is in its positive state.

A study was made for obtaining an appropriate ejection velocity for forming each of the large-sized, medium-sized and small-sized dots, by using a plurality of inkjet heads each of which is provided by the inkjet head 100 constructed as described above. In each of the used inkjet heads, the ejection velocity is peaked or maximized to about 9.2 m/s (=V0) when the pulse width is set at 5 μsec as the maximizing value T0. It is noted that there is some difference among the inkjet heads with respect to the curved line representative of ink ejection characteristic, which difference is due to difficulty in equally manufacturing the inkjet heads without variation therebetween.

In the formation of the large-sized dot, two ink droplets are ejected by the drive pulses P11, P12, and the ejected ink droplets are united to each other before or after landing on the recording medium. The united ink droplets cooperate with each other to form one dot (composite dot). The study revealed that the ejection velocity V1 of the ink droplets forming the large-sized dot is preferably not lower than 8.0 m/s and not higher than 10.0 m/s (8.0 m/s≦V1≦10.0 m/s) and is more preferably 9.0 m/s (V1=9.0 m/s). That is, it was confirmed that, as long as the ejection velocity V1 is held in the preferable range, the ink droplets were efficiently ejected without generating ink mists even in presence of influence of the cross talk.

In the formation of the large-sized dot, since the ink ejections are made by the successive drive pulses each having the pulse width close to the maximizing value, the two ink droplets are successively ejected with each of the two ink droplets having an efficiently increased volume. It is therefore considered that, even if an extra ink in the form of minute ink droplets is ejected concurrently with the ejection of the first ink droplet, the minute ink droplets are merged into the second ink droplet (following the first ink droplet) and then land on the recording medium, whereby generation of floating ink mists is avoided.

In the formation of the medium-sized dot, one ink droplet is ejected by the drive pulse P21. The study revealed that the ejection velocity V2 of the ink droplet forming the medium-sized dot is preferably not lower than 7.5 m/s and not higher than 8.5 m/s (7.5 m/s≦V2≦8.5 m/s) and is more preferably 8.0 m/s (V2=8.0 m/s). That is, it was confirmed that, as long as the ejection velocity V2 is held in the preferable range, the ink droplet was ejected without generating ink mists.

If the ejection velocity V2 of the ink droplet forming the medium-sized dot is set to be close to the maximizing value, as the above-described ejection velocity V1, the ejection velocity V2 is further increased in presence of the influence of the cross talk. In such a case, the excessively increased ejection velocity V2 causes ejection of the minute ink droplets as the extra ink. It is considered that the minute ink droplets are likely to float as ink mists without landing on the medium, since the medium-sized dot is formed of the one ink droplet rather than two successively ejected ink droplets. On the other hand, where the ejection velocity V2 is set in the above-described preferable range, namely, where the ejection velocity V2 is set to be lower than a conventional value, the minute ink droplets are not ejected, as described above.

It is preferable that the ejection velocity of the ink droplet or droplets forming each of the large-sized and medium-sized dots is set at a value deviated from its peak or maximized value (V0=9.2 m/s). If the ink droplet or droplets were ejected at the ejection velocity of the maximized value V0, the ink ejection could be made at the highest energy efficiency. However, since the curved line of FIG. 8 representative of the ejection characteristic somewhat varies among the individual inkjet heads, the maximized value V0 also varies from one to another. Thus, in the present embodiment, by not using the maximizing value V0 that is variable, the ink ejection is stabilized.

In the formation of the small-sized dot, one ink droplet is ejected by the drive pulse P31. The study revealed that the ejection velocity V3 of the ink droplet forming the small-sized dot is preferably not lower than 7.0 m/s and not higher than 8.0 m/s (7.0 m/s≦V3≦8.0 m/s) and is more preferably 7.5 m/s (V3=7.5 m/s). That is, it was confirmed that, as long as the ejection velocity V3 is held in the preferable range, the ink droplet was ejected without generating ink mists.

In the formation of the small-sized dot, the ink droplet caused to be ejected by the drive pulse P31 is partially pulled back, so that the volume of the ejected ink droplet is reduced, as described above. The reduction in the volume of the ink droplet leads to a reduction in the ejection velocity V3, and the ejection velocity V3 could be further reduced in presence of the influence of the cross talk. In such a case, the excessively reduced ejection velocity V3 causes ejection of the minute ink droplets as the extra ink. However, where the ejection velocity V3 is set in the above-described preferable range, namely, where the ejection velocity V3 is set to be higher than a value corresponding to a desired volume of the ink droplet, the minute ink droplets are not ejected even in presence of the influence of the cross talk, as described above.

Since the ejection velocity V3 is set to be higher than the value corresponding to the desired volume of the ink droplet, the actual volume of the ink droplet is made slightly larger than the desired volume of the ink droplet. Such a difference between the actual and desired volumes can be offset by controlling the number of ink droplets ejected onto a certain unit of area of the recording medium, in such a manner that minimizes deterioration in the recording quality. In the present embodiment, the inkjet head 100 is controlled, according to a software program installed on the controller, such that the number of the ink droplets ejected onto a certain unit of area is reduced by an amount corresponding to the increase of the actual volume of the ink droplet over the desired volume. For example, if there is a certain area onto which a total of ten ink droplets (each having the desired value) are to be ejected, the number of the ink droplets actually ejected on the certain area is reduced to eight.

Further, the study revealed that a preferable range of the ejection velocity V2 (for forming the medium-sized dot) relative to the ejection velocity V1 (for forming the large-sized dot) and a preferable range of the ejection velocity V3 (for forming the small-sized ink dot) relative to the ejection velocity V1 are as follows:

$$0.83V1 \leqq V2 \leqq 0.95V1$$

$$0.77V1 \leqq V3 \leqq 0.89V1$$

That is, with the ejection velocities V1, V2, V3 being set to be values cooperating to satisfy the above-described expressions, the inkjet printer satisfactorily produces an image having dots which are formed by the three kinds of dots (i.e., the large-sized, medium-sized and small-sized dots), without generation of the ink mists which could contaminate inside of the inkjet printer.

An experiment was conducted by the present inventor for obtaining a waveform of the medium-sized-dot forming pulse train which causes the ejection velocity V2 to be set at the above-descried value (V2=8.0 m/s) suitable for prevention of generation of the ink mists and also a waveform of the small-sized-dot forming pulse train which causes the ejection velocity V3 to be set at the above-descried value (V3=7.5 m/s) suitable for prevention of generation of the ink mists. The large-sized-dot forming pulse train includes the three drive pulses P31, P32, P33, as shown in FIG. 7A. The medium-sized-dot forming pulse train includes the two drive pulses P21, P22, as shown in FIG. 7B. The small-sized-dot forming pulse train includes the two drive pulses P31, P32, as shown in FIG. 7C. In the following description, the pulse width of each of the first drive pulses P11, P21, P31 is referred to as a pulse width T1, the pulse width of each of the second drive pulses P12, P22, P32 is referred to as a pulse width T2, the pulse width of the third drive pulses P13 is referred to as a pulse width T3, a pulse separation between the first and second drive pulses is referred to as a pulse separation W1, and a pulse separation between the second and third drive pulses is referred to as a pulse separation W2. It is note that the term "pulse separation" used in the present specification is interpreted to mean a time interval between the trailing edge of one drive pulse and the leading edge of the succeeding drive pulse.

In the experiment, the ink ejections were carried out, as shown in FIG. 9, with a total of sixteenth combinations (Nos. 1-16) of the values T1, T2, W1 prepared for the formation of the small-sized dot, and with a total of fifteen combinations (Nos. 21-35) of the values T1, T2, W1 prepared for the formation of the medium-sized dot. The ink ejections with theses combinations of the values T1, T2, W1 were carried out at each of the plurality of inkjet heads each of which is provided by the inkjet head 100 constructed as described above, and their results were evaluated with respect to three items, i.e., "EJECTION VELOCITY", "EJECTION STABILITY" and "EJECTION AMOUNT". In the item "EJECTION VELOCITY", it was determined whether the ink droplet for forming the small-sized dot or medium-sized dot was actually ejected at the ejection velocity of the above-described value. In the item "EJECTION STABILITY", it was determined whether a multiplicity of patterns of images having the large-sized, medium-sized and small-sized dots mixedly arranged therein were produced without suffering generation of ink mists. In the item "EJECTION AMOUNT", it was determined whether the small-sized dot or medium-sized dot having a desired size was formed on the recording medium. The results with respect to the evaluation items are indicated by "○" (excellent), "Δ" (fair) and "X" (poor).

As is apparent from the table of FIG. 9, in the formation of the small-sized dot, only four combinations Nos. 10, 11, 13, 14 (asterisked in the table) provided excellent results with respect to all of the three evaluation items. In the formation of the medium-sized dot, only three combinations Nos. 31, 32, 33 (asterisked in the table) provided excellent results with respect to all of the three evaluation items. These results revealed that the small-sized dot formation was satisfactorily made by stable ejection performance of the inkjet heads without suffering generation of ink mists, where the small-sized-dot forming pulse train had a waveform that satisfies a condition expressed by T1=3.8 μsec, 3.0 μsec≦W1≦3.4 μsec and T2=1.8 μsec, or a condition expressed by T1=4.2 μsec, 2.6

μsec≦W1≦3.0 μsec and T2=1.8 μsec. Since it is experimentally or experientially known that small deviation or variation in the values of the pulse width and separation is permissible as tolerance, it is preferable that the waveform of the small-sized-dot forming pulse train is configured such that the value of the pulse width T1 of the drive pulse P31 relative to the above-described maximizing value T0 satisfies 0.68T0<T1<0.92T0, the value of the pulse width T2 of the drive pulse P32 relative to the maximizing value T0 satisfies 0.32T0<T2<0.4T0, and the value of the pulse separation W1 (between the drive pulses P31, P32) relative to the maximizing value T0 satisfies 0.47T0<W1<0.76T0. It is more preferable that the waveform of the small-sized-dot forming pulse train is configured such that the value of the pulse width T1 relative to the maximizing value T0 satisfies T1=0.76T0 or 0.84T0, the value of the pulse width T2 relative to the maximizing value T0 satisfies T2=0.36T0, and the value of the pulse separation W1 relative to the maximizing value T0 satisfies W1=0.52T0, 0.6T0 or 0.68T0.

The results of the experiment also revealed that the medium-sized dot formation was satisfactorily made by stable ejection performance of the inkjet heads without suffering generation of ink mists, where the medium-sized-dot forming pulse train had a waveform that satisfies a condition expressed by T1=6.0 μsec, 7.6 μsec≦W1≦8.4 μsec and T2=7.2 μsec. That is, it is preferable that the waveform of the medium-sized-dot forming pulse train is configured such that the value of the pulse width T1 of the drive pulse P21 relative to the maximizing value T0 satisfies 1.0T0<T1<1.32T0, the value of the pulse width T2 of the drive pulse P22 relative to the maximizing value T0 satisfies 1.36T0<T2<1.52T0, and the value of the pulse separation W1 (between the drive pulses P21, P22) relative to the maximizing value T0 satisfies 1.37T0<W1<1.72T0. It is more preferable that the waveform of the medium-sized-dot forming pulse train is configured such that the value of the pulse width T1 relative to the maximizing value T0 satisfies T1=1.2T0, the value of the pulse width T2 relative to the maximizing value T0 satisfies T2=1.44T0, and the value of the pulse separation W1 relative to the maximizing value T0 satisfies W1=1.52T0, 1.6T0 or 1.68T0.

Further, another study was made for obtaining a waveform of the large-sized-dot forming pulse train which causes the ejection velocity V1 to be set at the above-descried value (V1=9.0 m/s) suitable for prevention of generation of the ink mists. Although the result of the study is not specifically described, it was confirmed in the study that a waveform of the large-sized-dot forming pulse train preferably satisfies a condition expressed by T1=6.0 μsec, T2=6.0 μsec, T3=7.0 μsec, W1=5.0 μsec and W2=9.6 μsec. That is, it is preferable that the waveform of the large-sized-dot forming pulse train is configured such that the value of the pulse width T1 of the drive pulse P11 relative to the maximizing value T0 satisfies 0.9T0<T1<1.3T0, the value of the pulse width T2 of the drive pulse P12 relative to the maximizing value T0 satisfies 0.9T0<T2<1.3T0, the value of the pulse width T3 of the drive pulse P13 relative to the maximizing value T0 satisfies 1.2T0<T3<1.5T0, the value of the pulse separation W1 (between the drive pulses P11, P12) relative to the maximizing value T0 satisfies 0.9T0<W1<1.1T0, and the value of the pulse separation W2 (between the drive pulses P12, P13) relative to the maximizing value T0 satisfies 1.7T0<W2<2.1T0. It is more preferable that the waveform of the medium-sized-dot forming pulse train is configured such that the value of the pulse width T1 relative to the maximizing value T0 satisfies T1=1.2T0, the value of the pulse width T2 relative to the maximizing value T0 satisfies T2=1.2T0, the value of the pulse width T3 relative to the maximizing value T0 satisfies T3=1.4T0, the value of the pulse separation W1 relative to the maximizing value T0 satisfies W1=1.0T0, and the value of the pulse separation W2 relative to the maximizing value T0 satisfies W2=1.92T0.

It is noted that the present invention is applicable also to an inkjet printer as disclosed in JP-H09-52357A in which the ink droplet is ejected by shear mode deformation of piezoelectric element of the actuator unit. In this case, the voltage of the control signal supplied to each actuator of the actuator unit is held in the second level (e.g., 0 V), and is raised in the first level causing the volume of the corresponding pressure chamber to be reduced when the corresponding pressure chamber is selected as an active pressure chamber from which the ink ejection is to be caused.

What is claimed is:

1. An ink droplet ejection device comprising:

a plurality of nozzles;

a plurality of pressure chambers held in communication with the respective nozzles;

a common ink chamber held in communication with said pressure chambers so as to distribute an ink into said pressure chambers;

a plurality of actuators each operable to apply an ejection pressure to the ink stored in a corresponding one of said pressure chambers, for causing an ink ejection from said corresponding one of said pressure chambers through one of said nozzles that is held in communication with said corresponding pressure chamber, whereby an image formed as a result of the ink ejection is produced on a medium; and a controller operable to supply a control signal to each of said plurality of actuators, and including (a) a composite-dot forming command portion operable to incorporate a composite-dot forming pulse train into said control signal supplied to each of said plurality of actuators, for causing the corresponding pressure chamber to successively eject a plurality of ink droplets that cooperate with each other to form a composite dot of the image, and (b) a non-composite-dot forming command portion operable to incorporate a non-composite-dot forming pulse train into said control signal, for causing the corresponding pressure chamber to eject a single ink droplet that forms a non-composite dot of the image, wherein said composite-dot forming pulse train and said non-composite-dot forming pulse train have respective waveforms that are configured such that an ejection velocity of said single ink droplet forming the non-composite dot is lower than an ejection velocity of said plurality of ink droplets cooperating to form the composite dot.

2. The ink droplet ejection device according to claim 1, wherein said composite-dot forming command portion of said controller includes a large-sized dot forming command portion operable to incorporate a large-sized-dot forming pulse train into said control signal, for causing formation of a large-sized dot as the composite dot by the plurality of ejected ink droplets, wherein said non-composite-dot forming command portion of said controller includes (b-1) a medium-sized-dot forming command portion operable to incorporate a medium-sized-dot forming pulse train into said control signal, for causing formation of a medium-sized dot as the non-composite dot by the ejected single ink droplet, and (b-2) a small-sized-dot forming command portion operable to incorporate a small-sized-dot forming pulse train into said control signal, for causing formation of a small-sized dot as the non-composite dot by the ejected single ink droplet, and wherein said large-sized-dot forming pulse train, medium-sized-dot forming pulse train and small-sized-dot forming pulse train have respective waveforms that are configured, such that an ejection velocity of said ejected single ink droplet forming the medium-sized dot is lower than an ejection velocity of said plurality of ejected ink droplets forming the large-sized dot, and is higher than an ejection velocity of said ejected single ink droplet forming the small-sized dot.

3. The ink droplet ejection device according to claim 2, wherein said medium-sized-dot forming pulse train includes a drive pulse having a pulse width that is larger than a maximizing value that enables each ink droplet to be ejected at a maximized velocity.

4. The ink droplet ejection device according to claim 2, wherein said small-sized-dot forming pulse train includes a first drive pulse for causing ejection of the ink droplet and a second drive pulse for inhibiting a part of the ink droplet from being ejected.

5. The ink droplet ejection device according to claim 2, wherein each of said actuators applies the ejection pressure to the ink stored in said corresponding pressure chambers, by changing a volume of said corresponding pressure chambers, wherein each of said large-sized-dot forming pulse train, medium-sized-dot forming pulse train and small-sized-dot forming pulse train includes at least one drive pulse causing an ink droplet ejection, wherein each of said large-sized-dot forming pulse train, medium-sized-dot forming pulse train and small-sized-dot forming pulse train includes (i) at least one first voltage-level region and (ii) at least one second voltage-level region that are alternatively arranged in each of said pulse trains, wherein a voltage of said control signal is held in a first level in said at least one first voltage-level region, which causes each of said actuators to reduce said volume of said corresponding pressure chamber, wherein said voltage of said control signal is held in a second level in said at least one second voltage-level region, which causes each of said actuators to increase said volume of said corresponding pressure chamber, and wherein each of said at least one drive pulse is provided by a corresponding one of said at least one second voltage-level region, and a pulse width of each of said at least one drive pulse corresponds to a time length of a corresponding one of said at least one second voltage-level region.

6. The ink droplet ejection device according to claim 5, wherein said voltage of said control signal supplied from said controller to each of said actuators is held in said first level until said corresponding pressure chamber is selected as an active pressure chamber from which the ink ejection is to be caused, and wherein said voltage of said control signal is placed in said second level when said corresponding pressure chamber is selected as said active pressure chamber.

7. The ink droplet ejection device according to claim 2, wherein said ejection velocity of said plurality of ejected ink droplets forming the large-sized dot and said ejection velocity of said ejected single ink droplet forming the medium-sized dot cooperate to satisfy the following expression:

$$0.83V1 \leqq V2 \leqq 0.95V1$$

where "V1" represents said ejection velocity of said plurality of ejected ink droplets forming the large-sized dot, and "V2" represents said ejection velocity of said ejected single ink droplet forming the medium-sized dot.

8. The ink droplet ejection device according to claim 2, wherein said ejection velocity of said plurality of ejected ink droplets forming the large-sized dot and said ejection velocity of said ejected single ink droplet forming the small-sized dot cooperate to satisfy the following expression:

$$0.77V1 \leqq V3 \leqq 0.89V1$$

where "V1" represents said ejection velocity of said plurality of ejected ink droplets forming the large-sized dot, and "V3" represents said ejection velocity of said ejected single ink droplet forming the small-sized dot.

9. The ink droplet ejection device according to claim 2, wherein said ejection velocity of said plurality of ejected ink droplets forming the large-sized dot is from 8.0 m/s to 10.0 m/s, wherein said ejection velocity of said ejected single ink droplet forming the medium-sized dot is from 7.5 m/s to 8.5 m/s, and wherein said ejection velocity of said ejected single ink droplet forming the small-sized dot is from 7.0 m/s to 8.0 m/s.

10. The ink droplet ejection device according to claim 3, wherein said maximizing value corresponds to a length of a propagation time required for a pressure wave to be propagated from said common ink chamber to each of said nozzles via a corresponding one of said pressure chambers.

* * * * *